US005420190A

United States Patent [19]

Gane

[11] Patent Number: 5,420,190

[45] Date of Patent: May 30, 1995

[54] PAPER COATING

[75] Inventor: Patrick A. C. Gane, Liskeard, United Kingdom

[73] Assignee: ECC International Limited, United Kingdom

[21] Appl. No.: 66,021

[22] PCT Filed: Nov. 28, 1991

[86] PCT No.: PCT/GB91/02109

§ 371 Date: May 24, 1993

§ 102(e) Date: May 24, 1993

[87] PCT Pub. No.: WO92/09746

PCT Pub. Date: Jun. 11, 1992

[30] Foreign Application Priority Data

Nov. 29, 1990 [GB] United Kingdom ..... 9026012

[51] Int. Cl.[6] ..... C08K 3/34; B32B 3/00; B32B 7/00; B32B 5/16

[52] U.S. Cl. ..... 524/446; 524/423; 524/425; 524/431; 524/444; 524/447; 524/451; 428/211; 428/331; 428/323; 428/530; 428/537.5

[58] Field of Search ..... 524/423, 425, 431, 444, 524/447, 451, 446; 428/211, 331, 323, 530, 537.5

[56] References Cited

U.S. PATENT DOCUMENTS

| | | | |
|---|---|---|---|
| 3,714,107 | 1/1973 | Smith | 524/423 |
| 4,575,477 | 3/1986 | Werkema et al. | 524/423 |

FOREIGN PATENT DOCUMENTS

| | | |
|---|---|---|
| 2531731 | 2/1984 | France . |
| 57-66195 | 4/1982 | Japan . |
| 2139500 | 5/1990 | Japan . |
| 751729 | 7/1956 | United Kingdom . |
| 1223102 | 2/1971 | United Kingdom . |
| 2058734 | 4/1981 | United Kingdom . |
| 2139606 | 11/1984 | United Kingdom . |
| 2173131 | 10/1986 | United Kingdom . |
| 2224673 | 5/1990 | United Kingdom . |

*Primary Examiner*—Paul R. Michl
*Assistant Examiner*—La Vonda DeWitt
*Attorney, Agent, or Firm*—Klauber & Jackson

[57] ABSTRACT

There is disclosed a paper coating composition for use in preparing a coated paper for gravure printing, which composition comprises a suspension in water of 100 parts by weight, on a dry weight basis, of a pigment or mixture of pigments having a particle size distribution such that at least 75% by weight of the particles have an equivalent spherical diameter smaller than 2 μm, and a latex the particles of which do not swell appreciably in water and which have an average size less than 0.2 μm, the latex being employed in an amount such as to provide from 3 to 15 parts by weight latex solids and the composition being substantially free from any viscosifying, film-forming hydrophilic polymeric material.

13 Claims, 1 Drawing Sheet

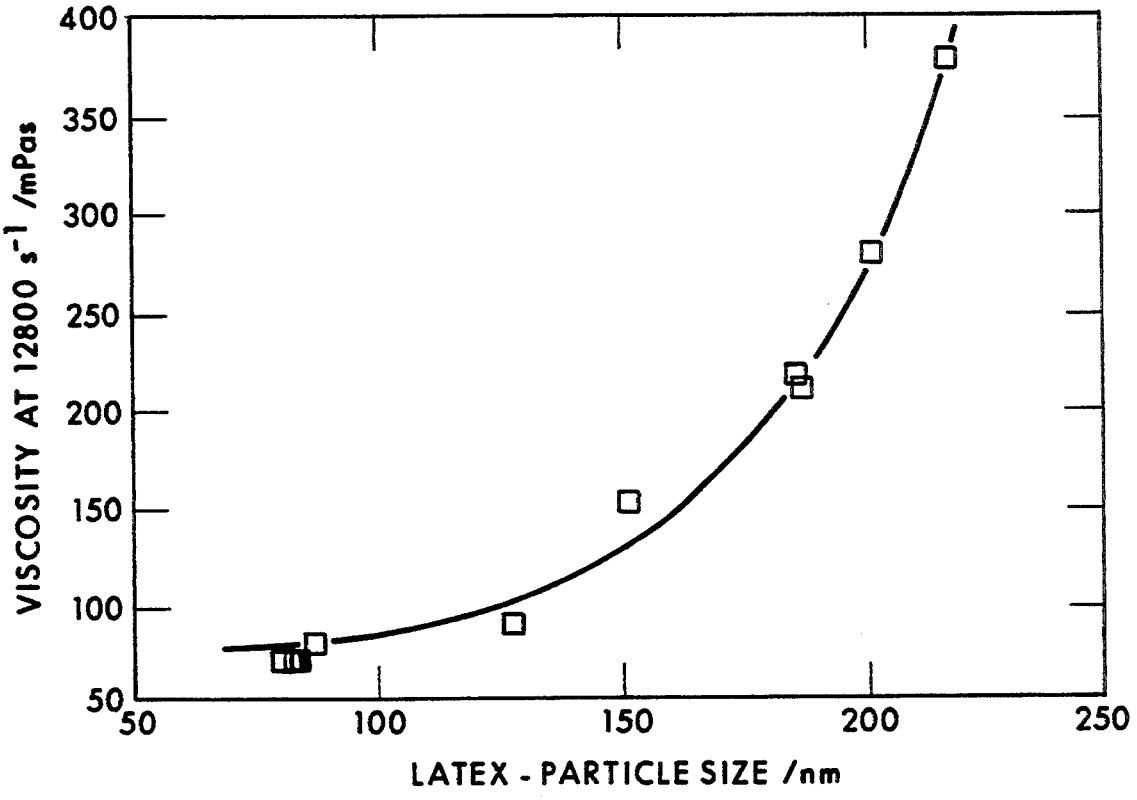
400
350
300
250
200
150
100
50
VISCOSITY AT 12800 s-1 /mPas
50
100
150
200
250
LATEX - PARTICLE SIZE /nm

PAPER COATING

BACKGROUND OF INVENTION

This invention relates to gravure printing and, more particularly but not exclusively, is concerned with a paper coating composition for use in preparing a coated paper for gravure printing, to a coated paper prepared using said composition, and to a gravure printing process using the coated paper.

Three main methods exist for applying printing ink to a paper surface, namely gravure, offset and letterpress. In theory, any of the three methods could be used to print any grade of paper, but in practice the quality of the print obtained depends significantly on the nature of the paper surface to which it is applied; and to achieve acceptable print quality the paper must normally possess certain properties which differ according to the method of printing to be used. Gravure printing is a form of intaglio printing, i.e. printing which uses a plate or cylinder constituting a former into the surface of which the subject matter to be printed is etched or engraved. A liberal film of fluid printing ink is supplied to the whole printing surface and the surface is then wiped, for example by a doctor blade, in order to remove all the ink from the unindented parts of the surface leaving ink only in the indentations or cells. Paper in a continuous web or in separate sheets is then pressed into contact with the inked surface in order to receive an impression of the subject matter.

In the most widely used kind of gravure printing, which is known as the rotogravure process, the subject matter, which may be textual or pictorial, is etched into the printing surface in the form of a matrix of cells which vary in depth and/or in surface area, so that the cells corresponding to the darker parts of the subject matter have a greater capacity for ink than the cells which correspond to the lighter parts of the subject mater. An image of the subject matter is formed by a photographic process on a sheet of carbon tissue which is impregnated with gelatine containing a light sensitive reagent. There is first formed on the sheet of carbon tissue a rectilinear grid having from about 50 to about 160 lines to the centimeter. The grid is formed by placing a screen consisting of small opaque squares separated by fine transparent lines in contact with the impregnated carbon tissue and exposing the screen to light so that the gelatine in the tissue immediately below the lines is rendered insoluble.

The image of the subject matter to be printed is then superimposed on the image of the screen by placing in contact with the carbon tissue a positive photographic transparency of the subject matter for the colour to be printed, and exposing the transparency to light. Again, the gelatine in areas of the carbon tissue lying immediately beneath clear areas of the transparency is rendered insoluble and in other areas the solubility of the gelatine is inversely proportional to the amount of light transmitted by the transparency. The carbon tissue is then placed over the surface of a specially prepared colour roller; those parts of the gelatine which are still soluble are washed away, and the surface of the roller is etched with a suitable reagent such as ferric chloride. The result is that the surface of the cylinder is etched in a pattern composed of a very large number of cells defined by a rectilinear grid, the depth of the cells in a particular area being dependant on the solubility of the gelatine in the carbon tissue overlying that area and thus on the amount of light transmitted through the transparency in that area.

Although the choice of a suitable paper for gravure printing is largely empirical and results can be obtained on a wide variety of different types of paper, ranging from newsprint to the finest matt paper, for best results the paper should generally be absorbent enough to take the ink without the exertion of undue pressure. It is not, however, essential that the paper is absorbent, although the surface of the paper should at least be wettable by the ink solvent. The surface to which the ink is applied must also be smooth, so that it makes intimate contact with every etched cell in the former so as to "pull" the ink out of the cell. Regions which fail to contact the former and hence to remove ink from the etched cell give rise to the problem of "missing dots" or "speckles", the extent of which is one of the main quality controlling parameters with gravure printing. A coated paper is generally required for the best results.

The gravure printing process is especially suitable for printing runs in which a large number of copies are required because the recessed cells of a gravure cylinder are less subject to wear through abrasion than the relief type of the letterpress process.

The process is therefore used for printing magazines, mail order catalogues and other periodical publications having a large circulation. There is an increasing trend to print this type of publication on a lightweight coated paper in order to minimise postal costs. Unfortunately, a very common defect which appears when subject matter is printed by gravure on lightweight coated papers is a speckled effect which is most noticeable in the middle tones. This effect is caused, as mentioned above, by poor contact between the surface of the paper and the surface of the cylinder so that the ink is not drawn out from some of the cells with the result that some of the minute dots which make up the printed images are missing.

A paper coating composition generally comprises a suspension in an aqueous medium of a pigment, or mixture of pigments, which may be selected from, for example, kaolin, calcium carbonate, talc, titanium dioxide, satin white and the like, and a binder or adhesive.

A typical conventional coating composition for preparing rotogravure paper in the European paper industry contains 100 parts by weight of pigment, from 0.05 to 0.5 parts by weight of a dispersing agent for the pigment, from 4 to 6 parts by weight of a self-thickening acrylic copolymer latex adhesive, sodium hydroxide to increase the pH to a value in the range of from 8.5 to 9.5, and water to give a suspension having a viscosity at 22° C. of around 1500 mPa.s, as measured by means of a Brookfield viscometer at a spindle speed of 100 rpm. In the United States paper industry the acrylic copolymer latex adhesive is usually replaced by from 3 to 4 parts by weights of a styrene butadiene latex and from 7 to 10 parts by weight of an oxidised starch, but this type of composition tends to give inferior gravure printing results to those obtained with a typical European formulation. Also, in both types of composition, it has been found that relatively coarse pigments, i.e. those having a mean particle diameter of about 2 μm, give rotogravure print quality results which are superior to those given by relatively fine pigments, i.e. those having a weight mean equivalent spherical diameter of about 0.5 μm. In British Patent Specification No. 2058734 a paper coating composition specially developed for rotogravure printing paper is described wherein the pigment is relatively coarse and has a particle size distribution which is narrower than that of a conventional pigment. In other words, the special pigment is relatively deficient in both the coarsest and the finest particles. It is believed that such a pigment gives improved rotogravure print quality on a paper coated with a composition containing the pigment, because the pigment provides a more compressible coating than do conventional pigments, and this results in better take-up of ink from the cells of a rotogravure printing cylinder. The compressibility is a result of the relatively poor packing characteristics of the pigment, which in turn is a consequence of its narrow particle size distribution.

For offset printing a coated paper must have different properties from those required for a rotogravure printing paper and different coating compositions are used. For example, a typical composition comprises 100 parts by weight of pigment, from 5 to 25, and preferably from 10 to 20, parts by weight of an adhesive, a dispersing agent for the pigment, auxiliary agents and water to give a total solids concentration of about 60% by weight. The adhesive is usually chosen from one or more of a protein derivative, a starch derivative, a cellulose derivative or a latex, and an example of a particular adhesive system would be 10 parts by weight of oxidised starch and 7 parts by weight of styrene-butadiene latex. The pigment would normally have a particle size distribution such that at least 80% by weight, and preferably at least 90% by weight, of its particles have an equivalent spherical diameter smaller than 2 μm in order to provide a coating of good gloss and brightness. The weight mean equivalent spherical diameter range for typical pigments suitable for offset coating compositions is from about 0.3 to about 0.8 μm. A coating composition intended for use in preparing a coated paper for offset printing generally comprises a hydrophilic polymer material, such as a starch derivative or a cellulose derivative, in order to increase the initial viscosity of the composition and thus inhibit the penetration of the aqueous phase of the composition into the paper web. In the absence of a viscosifying hydrophilic polymer material, as soon as the coating composition contacts the paper web, the aqueous phase tends to be absorbed into the body of the paper, with the result that the local concentration of solids in the composition is increased and the composition becomes so viscous that the shear forces to which it is exposed in the paper coating apparatus render it virtually incapable of passing through the narrow clearance which exists between the applicator device and the moving web. When the hydrophilic polymeric material is present, the surface of the paper web is effectively sealed, thus inhibiting further penetration of the aqueous phase into the paper. The hydrophilic polymeric material can act as both a viscosifier and an adhesive.

According to a first aspect of the present invention, there is provided a paper coating composition for use in preparing a coated paper for gravure printing, which composition comprises a suspension in water of 100 parts by weight, on a dry weight basis, of a pigment or mixture of pigments having a particle size distribution such that at least 75% by weight of the particles have an equivalent spherical diameter smaller than 2 μm, and a latex the particles of which do not swell appreciably in water and which have an average size less than 0.2 μm, the latex being employed in an amount such as to provide from 3 to 15 parts by weight latex solids and the composition being substantially free from any viscosifying, film-forming hydrophilic polymeric material.

As has been mentioned, the paper coating composition of the present invention is substantially free from any viscosifying, film-forming hydrophilic polymeric material. Although such polymers are commonly employed in paper coating compositions for use in preparing coated papers for printing by the offset method, they are detrimental when the printing of an image is to be by a gravure technique for the reason that they are film-forming and therefore tend to make the surface of the coated paper inflexible; this contradicts one of the fundamental requirements of a coating on the surface of a gravure printing paper which is that it should be compressible and capable of flexing in order that the whole surface may make intimate contact with the printing roll so that full transfer of the image occurs during printing.

By "substantially free from any viscosifying, film-forming hydrophilic polymeric material", we mean that the composition contains no such polymeric material whatsoever, or trace amounts which have no appreciable viscosifying effect, i.e. less than about 0.1% by weight of the composition. Above this level, an unacceptable deterioration in gravure print quality has been observed. A film-forming polymer, in the context of the present invention, means a polymer which, if used in a paper coating composition otherwise in accordance with the present invention, will give a coating on a paper which is substantially inflexible and incompressible and therefore not suited to being printed on by a gravure printing technique.

According to a second aspect of the present invention, there is provided a coated paper, suitable for use in a gravure printing process, which paper is prepared by coating a base paper with a paper coating in accordance with the first aspect of the present invention.

According to a third aspect of the present invention, there is provided a gravure printing process comprising the step of gravure printing onto the surface of a coated paper in accordance with the second aspect of this invention.

Thus, the invention provides novel coating compositions for preparing coated paper for rotogravure printing, which coating compositions comprise finely divided pigments of the type which give good gloss and opacity properties when used in the production of offset printing papers, but which have hitherto been found to give inferior results in the rotogravure printing process.

The coated paper of the present invention is particularly suited to rotogravure printing.

According to a fourth aspect of the present invention, there is provided a paper coating process comprising the step of coating a paper web with a paper coating composition in accordance with the first aspect of this invention.

It is preferred that the pigment, or pigment mixture, should not contain too many coarse particles, typically no more than 10% by weight having an equivalent spherical diameter larger than 5 μm.

The solid particles of the latex preferably comprise a non-swelling styrene-butadiene copolymer or a non-swelling acrylic copolymer. Preferably, the average particle size of the latex is at least 0.05 μm. The technique of dynamic light scattering or photon correlation spectroscopy is used to measure the average particle size of the latex.

The composition preferably contains from 4 to 8 parts by weight of the latex solids.

The pigment may comprise one or more of kaolin, metakaolin, calcium carbonate, calcium sulphate, talc, titanium dioxide, barium sulphate, satin white or the like. Conveniently the average diameter of the pigment is in the range from 0.3 to 0.8 μm.

BRIEF DESCRIPTION OF THE DRAWING

The FIGURE is a graph showing the effect on viscosity of latex particle size, in a paper coating composition pursuant to the invention.

DESCRIPTION OF THE PREFERRED EMBODIMENTS

In the paper coating process of the present invention, and in order to minimise the passage of water from the coating composition into the paper with a resultant increase in the viscosity of the composition, it is preferred to apply the coating composition to a moving paper web using an apparatus such that the composition (whilst in the coating head) is in contact with the moving web for a time not exceeding 40 milliseconds. Suitable paper coating devices which fulfil this condition are described in British Patent Specifications Nos. 2173131 and 2224673.

Preferably the pigment has a mean particle aspect ratio of at least 25. By the expression "particle aspect ratio" is meant "the diameter of a circle of area equivalent to that of the largest face of a particle relative to the mean thickness of that particle". It has been found that paper coating compositions which contain pigments which naturally have, or which have been processed to have, particles which are "platey" or of high aspect ratio tend to retain their water content more effectively when in contact with a paper web under pressure than compositions containing pigments of lower mean particle aspect ratio. It is thought that this is because water is less readily squeezed out between the pigment particles under pressure. In order to have such pressure water retention, the pigment should also preferably have a small but significant proportion by weight of particles which have an equivalent spherical diameter smaller than 0.25 μm, as well as the high aspect ratio. The water retention of the pigment component of the coating composition is especially important when the composition is subjected to pressure while in contact with the web, as in the pressure region of a "short dwell" coating head.

The invention is further illustrated by the following Example.

EXAMPLE 1

A rotogravure base paper of weight 40 $gm^{-2}$ was coated by means of a laboratory paper coating apparatus of the type described in British Patent Specification No. 2224673 with samples of three different coating compositions A, B and C having the compositions and properties set forth in Table I below:

TABLE I

| | A | B | C |
|---|---|---|---|
| Kaolin (parts by wt.) | 100 | 100 | 100 |
| Non-swelling styrene butadiene latex (parts by wt.) - Invention | 0 | 4.5 | 11.0 |
| Self-thickening acrylic copolymer latex (parts by wt.) - Comparative | 4.5 | 0 | 0 |
| % by weight of solids | 50.3 | 64.8 | 64.6 |
| Brookfield viscosity (mPa · s) | 860 | 270 | 250 |
| Ferranti-Shirley viscosity (mPa · s) | 32 | 144 | 67 |

In each case the kaolin was an English paper coating grade kaolin having a particle size distribution such that 80% of the particles have an equivalent spherical diameter smaller than 2 μm and such that the average particle diameter is 0.75 μm, and the mean particle aspect ratio is 30:1. The styrene butadiene latex (non-swelling) was that known as Dow Latex 675 sold by Dow Chemical Company; by way of comparison (i.e. not in accordance with the invention), the self-thickening acrylic copolymer latex was that sold under the name S548V manufactured by BASF AG.

In the case of the two latices, the parts by weight given in the above Table refer to the parts by weight of actual copolymer solids. The latices each contain 50% by weight of copolymer solids in water. The average particle size of the acrylic copolymer latex measured at pH 7 was 0.255 μm and the average particle size of the styrene butadiene latex measured at pH 7 was 0.185 μm.

The percentage by weight of solids in each composition was determined by experiment as that at which the composition would flow easily beneath the blade of the laboratory coating apparatus with the coating blade set at an angle of 45° with the tangent to the surface of the drum supporting the base paper at the point of contact with the blade.

The Brookfield viscosity was determined using a Brookfield Viscometer at a spindle speed of 100 rpm which corresponds to a shear rate of 30 $s^{-1}$ and the Ferranti-Shirley viscosity was determined by means of a Ferranti-Shirley Viscometer at a shear rate of 12840 $s^{-1}$.

The base paper was coated with each of the three compositions at different coat weights within the range of from about 6 to about 12 $gm^{-2}$ and the coated sheets were dried and calendered under conditions such that the paper was passed ten times through the nip of the calender rolls under a pressure of 375 pounds per linear inch (67 kg. per linear cm.).

The samples of coated paper were then tested for gravure print quality by the technique described in the article "Realistic paper tests for various printing processes" by A. Swan, published in "Printing Technology", vol. 13, no.1, April, 1969, pages 9–22. The test prints were compared with standards numbered 1 to 7, the lowest number representing the least number of missing dots per unit area, and therefore the best print quality.

The samples of coated paper were also tested for opacity using an Elrepho brightness meter fitted with a No. 10 (Commission Internationale d'Éclairage "Y") filter. This filter embraces a broad band of wavelengths in the visible spectrum but is generally green in colour. A stack of sheets of the coated paper thick enough to guarantee no transmission of light through the stack was first placed in the instrument and the scale reading was adjusted to 100. The stack of sheets was then replaced by a single sheet on a black background and the scale reading gave the percentage opacity of the sheet. The final result was the average of ten measurements made in this way using different sheets taken from the same sample.

The gloss of the samples of coated paper was also determined by the method described in TAPPI Standard No. T480 ts-85 using a Hunterlab D16 gloss meter at an angle of 75° with the normal to the paper.

In each case the gravure print quality, opacity and gloss results respectively were plotted against coat weight and the result for a coat weight of 9 $gm^{-2}$ was found by interpolation.

The results obtained are set forth in Table II below:

TABLE II

| Composition (at 9 $gm^{-2}$) | Gravure Print quality (% missing dots) | Opacity (%) | Gloss (TAPPI units) |
|---|---|---|---|
| A | 2.8 | 86.0 | 53.5 |
| B | 1.3 | 86.6 | 71.3 |
| C | 1.7 | 85.1 | 68.2 |

These results show that the best results for gravure print quality, opacity and gloss are all obtained with Composition B which contains, as the adhesive, 4.5% by weight, based on the weight of dry kaolin pigment, of non-swelling styrene butadiene latex solids the average particle size of the latex, when measured at pH 7, being 0.185 μm.

EXAMPLE 2

Paper coating compositions of the type suitable for preparing a rotogravure printing paper were prepared according to the following formulation:

| | Parts by weight |
|---|---|
| Kaolin | 100 |
| Styrene butadiene latex | 11 |

The kaolin was the same as was used in Example 1, but nine different non-swelling styrene butadiene latices were used, of varying particle size and hardness. The "hardness" of a styrene butadiene latex is governed by the ratio of styrene monomer to butadiene monomer. A high ratio of styrene monomer to butadiene monomer gives a hard latex.

In each case the quantity of water in which the kaolin and the latex were suspended was adjusted to give a total solids content of 66% by weight. The high shear viscosity of each paper coating composition was determined by means of a Ferranti-Shirley Viscometer at a shear rate of 12800 $s^{-1}$, and the results are set forth in Table III below:

TABLE III

| Average particle size of latex measured at pH 7 (μm) | Latex hardness | Ferranti-Shirley Viscosity (mPa · s) |
|---|---|---|
| 0.081 | soft | 68 |
| 0.083 | hard | 68 |
| 0.086 | soft | 78 |
| 0.128 | medium | 88 |
| 0.152 | hard | 155 |
| 0.185 | medium | 214 |
| 0.186 | hard | 201 |
| 0.202 | soft | 277 |
| 0.218 | hard | 380 |

The results are also plotted graphically in the FIGURE.

It can be seen from these results that an increase in the average particle size of the latex above about 0.2 μm causes a rapid increase in the high shear viscosity of the coating composition, which, in turn, would cause a deterioration in the gravure print quality of the coated paper prepared with the composition.

In each of these examples, the average particle size of the latex was measured by the technique known as dynamic light scattering or photon correlation spectroscopy.

I claim:

1. A paper coating composition for use in preparing a coated paper for gravure printing, which composition comprises a suspension in water of 100 parts by weight, on a dry weight basis, of a pigment or mixture of pigments having a particle size distribution such that at least 75% by weight of the particles have an equivalent spherical diameter smaller than 2 μm, and a latex the particles of which do not swell appreciably in water and which have an average size less than 0.2 μm, the latex being employed in an amount such as to provide from 3 to 15 parts by weight latex solids and the composition including less than about 0.1% by weight of any viscosifying, film-forming hydrophilic polymeric material.

2. A paper coating composition according to claim 1, wherein the solid particles of the latex comprise a non-swelling styrene-butadiene copolymer or a non-swelling acrylic copolymer.

3. A paper coating composition according to claim 1, wherein the average size of the particle of the latex is at least 0.05 μm.

4. A paper coating composition according to claim 1, wherein the latex is employed in an amount sufficient to provide from 4 to 8 parts by weight of the latex solids.

5. A paper coating composition according to claim 1, wherein the pigment comprises one or more of kaolin, metakaolin, calcium carbonate, calcium sulphate, talc, titanium dioxide, barium sulphate or satin white.

6. A paper coating composition according to claim 1, wherein the average diameter of the particles of the pigment is in the range of from 0.3 to 0.8 μm.

7. A paper coating composition according to claim 1, wherein the pigment employed has a mean particle aspect ratio of at least 25.

8. A paper coating composition according to claim 1, wherein the pigment, or pigment mixture contains no more than 10% by weight of particles having an equivalent spherical diameter larger than 5 μm.

9. A coated paper, suitable for use in a gravure printing process, which paper is prepared by coating a base paper with a paper coating composition, which composition comprises a suspension in water of 100 parts by weight, on a dry weight basis, of a pigment or mixture of pigments having a particle size distribution such that at least 75% by weight of the particles have an equivalent spherical diameter smaller than 2 μm, and a latex the particles of which do not swell appreciably in water and which have an average size less than 0.2 μm, the latex being employed in an amount such as to provide from 3 to 15 parts by weight latex solids and the composition including less than about 0.1% by weight of any viscosifying, film-forming hydrophilic polymeric material.

10. A gravure printing process comprising the step of gravure printing on to the surface of a coated paper, said coated paper being prepared by coating a base paper with a paper coating composition, which composition comprises a suspension in water of 100 parts by weight, on a dry weight basis, of a pigment or mixture of pigments having a particle size distribution such that at least 75% by weight of the particles have an equivalent spherical diameter smaller than 2 μm, and a latex the particles of which do not swell appreciably in water and which have an average size less than 0.2 μm, the latex being employed in an amount such as to provide from 3 to 15 parts by weight latex solids and the composition including less than about 0.1% by weight of any viscosifying, film-forming hydrophilic polymeric material.

11. A paper coating process comprising the step of coating a paper web with a paper coating composition which comprises a suspension in water of 100 parts by weight, on a dry weight basis, of a pigment or mixture of pigments having a particle size distribution such that at least 75% by weight of the particles have an equivalent spherical diameter smaller than 2 μm, and a latex the particles of which do not swell appreciably in water and which have an average size less than 0.2 μm, the latex being employed in an amount such as to provide from 3 to 15 parts by weight latex solids and the composition including less than about 0.1% by weight of any viscosifying, film-forming hydrophilic polymeric material.

12. A paper coating process according to claim 11, wherein the coating composition is applied to a moving paper web using an apparatus such that the composition is in contact with the moving web for a time not exceeding 40 milliseconds.

13. A paper coating composition according to claim 2, wherein the average size of the particle of the latex is at least 0.05 μm.

* * * * *